United States Patent [19]

Peterson et al.

[11] Patent Number: 4,506,121

[45] Date of Patent: Mar. 19, 1985

[54] ANTI-OVERLOAD OPERATING LINKAGE FOR ENCLOSED INTERLOCKED RECEPTACLE WITH SAFETY SWITCH OR CIRCUIT BREAKER

[75] Inventors: Brian P. Peterson, Jamesville; Patrick J. Murphy, Camillus, both of N.Y.

[73] Assignee: Cooper Industries, Inc., Houston, Tex.

[21] Appl. No.: 440,729

[22] Filed: Nov. 10, 1982

[51] Int. Cl.[3] ..... H01H 9/20

[52] U.S. Cl. ..... 200/50 B; 74/470; 200/153 V

[58] Field of Search ..... 200/50 B, 153 V, 50 A, 200/50 C; 74/470

[56] References Cited

U.S. PATENT DOCUMENTS

| | | | |
|---|---|---|---|
| 2,332,633 | 10/1943 | Green | 200/50 A |
| 3,055,226 | 9/1962 | Kiessling . | |
| 3,575,565 | 4/1971 | Silvius . | |
| 3,633,435 | 1/1972 | Farr . | |
| 4,150,271 | 4/1979 | McMillen . | |
| 4,210,788 | 7/1980 | Stranczek . | |

*Primary Examiner*—A. D. Pellinen

*Assistant Examiner*—Morris Ginsburg

*Attorney, Agent, or Firm*—Finnegan, Henderson, Farabow, Garrett & Dunner

[57] ABSTRACT

A force override compensating device as one component of the mechanical operating linkage in an electrical socket interlocked dead front safety switch or circuit breaker. Distinct input and output members urged into rigid relation with each other by a spring bias mechanism function as a solid link under normal circumstances. With the interlocking mechanism immobilized, the bias mechanism permits waste movement of the input member relative output member, if an attempt is made erroneously to activate the device using such force as would damage any of the immobilized linkage elements of the locked device. The bias mechanism reverse waste movement of the input member when the erroneously applied force is released. Three embodiments of the invention are described: slidably mounted input and output members preloading therebetween a compression spring; pivotally connected input and output members having an extension spring under tension resisting their pivoting; and rotationally secured input and output members being torsion spring biased therebetween.

20 Claims, 9 Drawing Figures

FIG. 4.
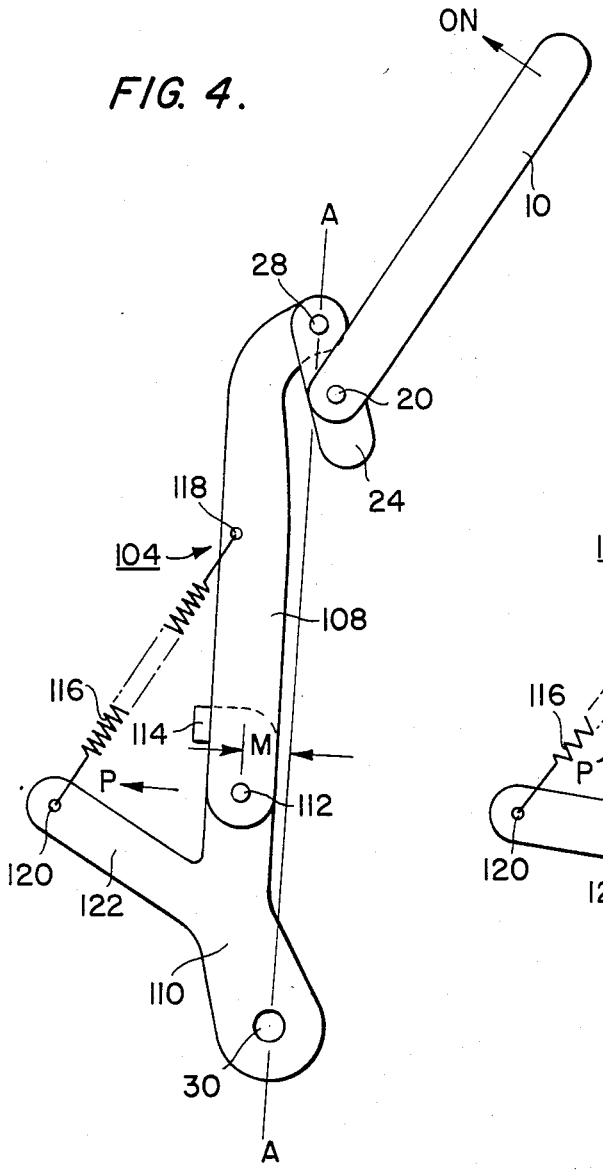
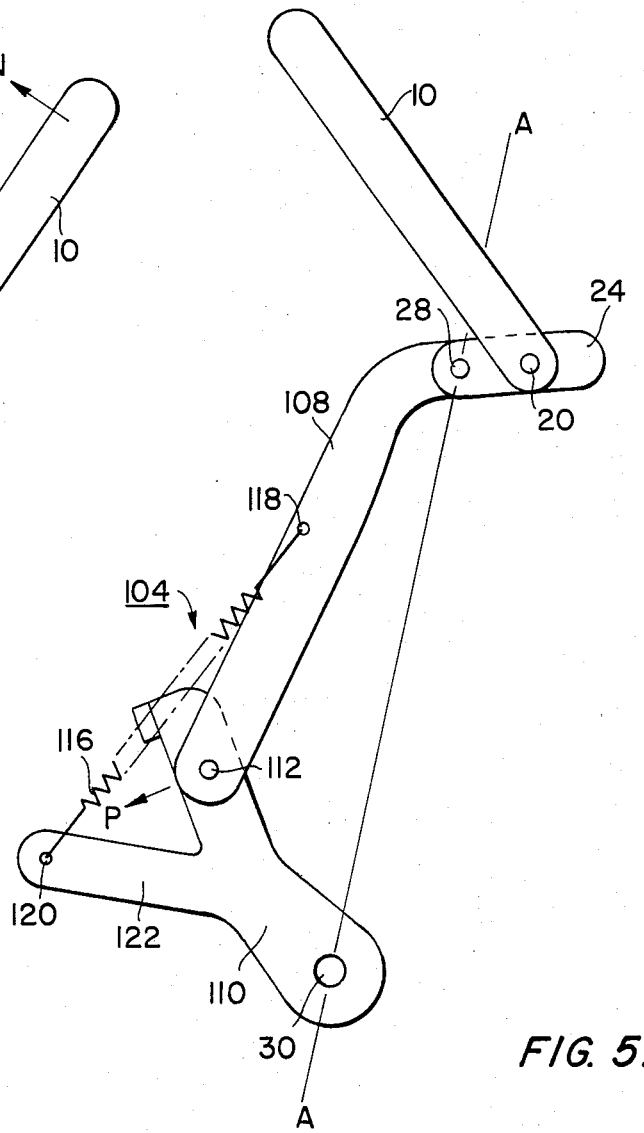
FIG. 5.
FIG. 6.
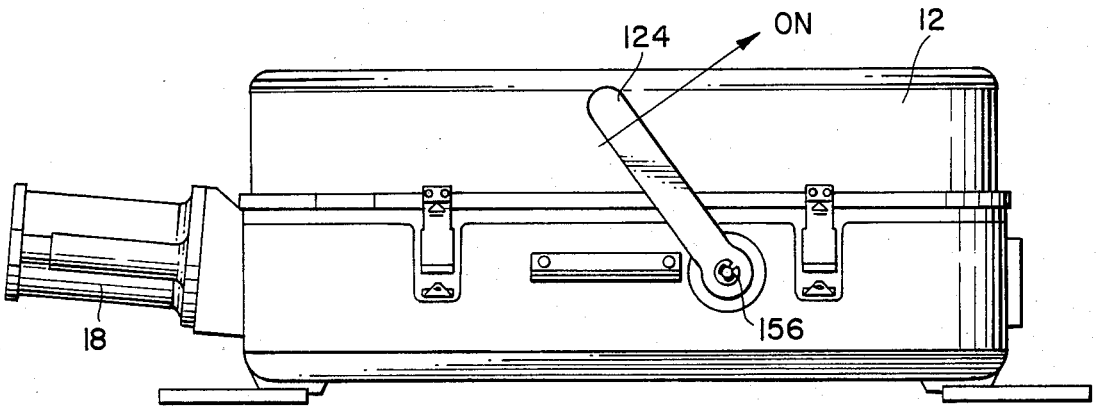

ANTI-OVERLOAD OPERATING LINKAGE FOR ENCLOSED INTERLOCKED RECEPTACLE WITH SAFETY SWITCH OR CIRCUIT BREAKER

BACKGROUND OF THE INVENTION

This invention relates to enclosed safety switches and circuit breakers with interlocked receptacles, and more particularly, to switches and circuit breakers having interlocked receptacles which provide true dead front safety.

BACKGROUND ART

Enclosed safety switches and circuit breakers are known having attached thereto electrical receptacles interlocked with the activating mechanisms of the switches or circuit breakers. These devices provide true dead front safety, in that an electrical plug cannot be inserted or withdrawn from the receptacles thereof unless the power to the receptacles is initially cut off at the switch or circuit breaker, In addition, once an electrical plug is withdrawn from the receptacle of such devices, that receptacle cannot be re-energized unless an electrical plug is fully reinserted therein. If an electrical plug is not fully inserted into the socket of a dead front safety device, the switch or circuit breaker associated therewith is prevented from being moved to the "on" position through an internal interlocking mechanism. Thus, until proper electrical plug insertion, dead front devices are locked in a de-energized state.

It has been found that dead front safety devices interlocked in the de-energized state are themselves vulnerable to damage from the efforts of an inattentive or poorly trained operator to nevertheless restore power to the devices. Typically, an operating handle, in the case of an enclosed switch, or a reset handle, in the case of an enclosed circuit breaker, is provided on the exterior of the housing of the device for turning on the power to an interlocked electrical socket. Due to the mechanical advantage afforded by such a handle, if the switch or circuit breaker is interlocked in an "off" position, it is easily within the strength of the typical operator to erroneously apply enough force to the handle to damage the internal linkage connecting the handle and its corresponding switch or circuit breaker. This commonly occurs if an operator fails to insert an electrical plug fully into the socket or fails to follow instructions by attempting to force the switch or circuit breaker handle into the "on" position without inserting a plug at all.

Moreover frequently upon application of excessive erroneous force to the handle of an enclosed switch or circuit breaker interlocked in the "off" position, destruction of an internal linkage in the device by permitting movement of the handle to the "on" position, gives an inaccurate indication that the interlocked electrical receptacle has been energized.

Until this invention, no true dead front safety device was free from the risks and expenses associated with internal damage arising from an erroneous attempt by the operator thereof to re-energize a switch or circuit breaker interlocked in the "off" position.

SUMMARY OF THE INVENTION

One object of the present invention is to reduce or eliminate the cost and delay associated with operator caused damage to enclosed safety switches or circuit breakers having attached interlocking electrical receptacles.

Another object of the invention is to provide a foolproof true dead front safety device which cannot be internally damaged by the erroneous efforts of an untrained or careless operator to operate the device when properly interlocked in the "off" position.

Yet another object of the present invention is to provide an enclosed safety switch or circuit breaker having an attached interlocking receptacle which absorbs any erroneously applied force of an operator without damage to the internal mechanisms thereof and which indicates to such an operator that power has not been restored to the socket thereof by returning its operating or reset handle to the "off" position when the grasp of the operator upon that handle is released.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a dead front safety device having a handle connected to a mechanism for energizing the safety device by a multi-component mechanical operating linkage for transmitting an operating force applied to the handle to the energizing mechanism, and having an interlock for preventing movement of the energizing mechanism until the release of the interlock by the undertaking of collateral safety related procedures, is provided in one embodiment of the present invention with a force override compensating linkage as one of the components of the mechanical operating linkage. The compensating linkage comprises a force-receiving member to which a driving force corresponding to the operating force is applied, a force-transmitting member, and bias means urging the force-receiving member into a rigid relation with the force-transmitting member. The force-transmitting member is movably connected to the force-receiving member and operably connected through components of the operating linkage to the energizing mechanism so as to impart to that mechanism an activating force corresponding to the driving force. Whenever the operating force exceeds a predetermined value, as when an operator attempts erroneously to re-energize the switch or circuit breaker interlocked in the "off" position, the bias means is overcome by the driving force to permit waste movement of the force-receiving member relative to the force-transmitting member.

Preferably the bias means also reverses any movement of the force-receiving member relative the force-transmitting member when the erroneously applied operating force ceases to be applied to the handle of the device.

In the present invention a force override device is provided for actuating a load having a movable state and an immovable state. The device comprises an input member having a rest position and an activated position, an output member attached to the load and movably connected to the input member, and multipurpose bias means responsive to the movement of the input member from its rest position. The bias means serves to actuate the load in the movable state upon the movement of the input member from its rest position to its activated position. In addition the bias means permits waste movement of the input member from the rest position under the application of an erroneously applied operator force greater than a predetermined threshhold whenever the load is in its immovable state. Finally, the bias means returns the input member to its rest position after the release of any such erroneously applied operator force. The output member is urged to the extent of the predetermined threshold force into a rigid relationship with the input member.

BRIEF DESCRIPTION OF THE DRAWINGS

The invention will be described with additional specificity and detail through the use of the accompanying drawings in which:

FIG. 4 is a side detail view of the embodiment of a force override compensating linkage shown in FIG. 3;

FIG. 5 is a side detail view of the linkage of FIG. 4 collapsed due to the application of excessive erroneous operating force;

FIG. 6 is a side view of an enclosed dead front safety device having mounted thereon a handle comprising a third force override compensating linkage embodying the present invention;

DESCRIPTION OF THE PREFERRED EMBODIMENT

In order to prevent accidental damage to the mechanical operating linkage of an enclosed switch or circuit breaker having an attached interlocking electrical receptacle, it is necessary to incorporate a compensating member somewhere in that operating linkage. The compensating member permits waste movement upon application thereto of forces exceeding a predetermined threshhold sufficient for activation of the switch or circuit breaker. Thus, the compensating linkage protects the remainder of the linkage components in the device from the application of damaging forces. Naturally, it is desirable and within the capability of the three embodiments of a compensating linkage described hereinafter, that the compensating linkage automatically resets itself by reversing any waste movement upon removal of the overloading force.

Safety switches and circuit breakers generally provide for the mounting of operating or reset handles either on the front face or the side of the housings thereof. The difference between the two types of housings requires different structures in compensating linkage designs. In the descriptions which follow, two such linkages suitable for use with handles mounted on the front face of a housing and one linkage suitable for use with handles mounted on the side thereof, will be described in detail.

Figure 1:
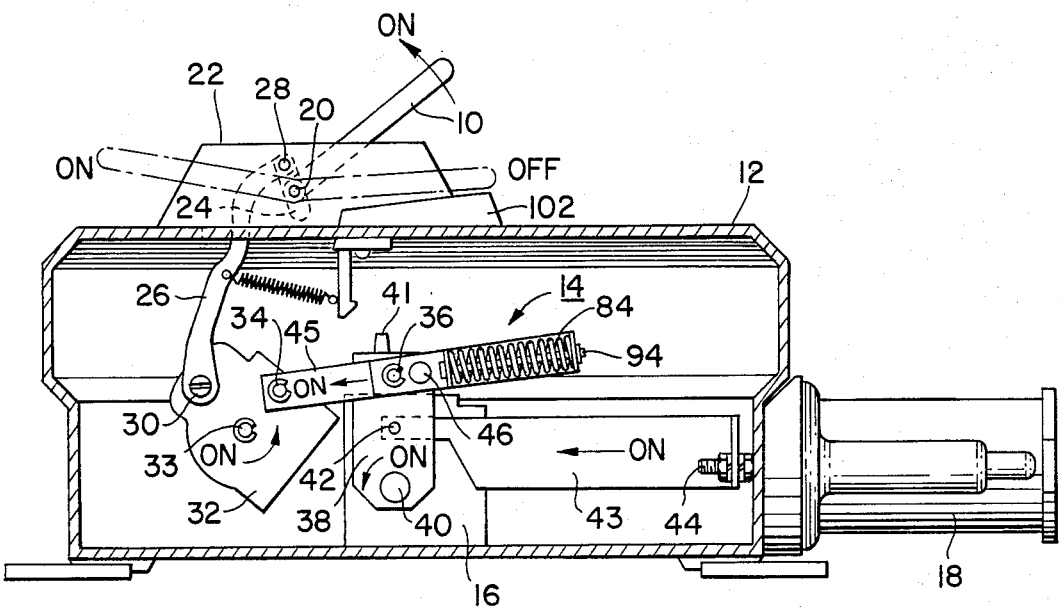
FIG. 1 is a side sectional elevation of an enclosed dead front safety device in which a force override compensating linkage embodying the present invention is operatively installed.

In FIG. 1, is shown a dead front safety device having a reset or operating handle 10 mounted on the front face of the housing 12 thereof. The side of housing 12 has been removed to reveal a first embodiment of a force override device or compensating linkage embodying the present invention designated generally by reference character 14 and shown operably connected as one element of a multi-component mechanical linkage for switch or circuit breaker 16 enclosed within housing 12 and interlocked with an electrical receptacle 18. Handle 10 moves between "off" and "on" positions (depicted in phantom) through rotation by an operator about a shaft 20 mounted in a boss 22 which may be an exposed, raised portion on the top of housing 12. Within boss 22 a cam 24 is also mounted for rotation about shaft 20 in a fixed relation with handle 10. Rotation of cam 24 is transmitted to the mechanisms inside housing 12 by a connector arm 26 connected at one end thereof to an off-center point 28 on cam 24 and at the opposite end therefrom at a point 30 on a faceplate 32. Responsive to the movement of operating handle 10 from the "off" to the "on" position, faceplate 32 rotates about an axis 33 in a direction indicated by the arrow shown. Compensating linkage 14 interconnects pins 34, 36 attached respectively to faceplate 32 and a bail 38. When faceplate 32 rotates in the direction indicated by the arrow thereupon, compensating linkage 14 moves in the direction indicated by the arrow appearing thereupon and bail 38 accordingly is made to rotate about a hub 40 thereby tripping a toggle 41, which energizes switch or circuit breaker 16. Bail 38 is further connected at a point 42, to one end of an interlock arm 43, the other end of which is bolted to a shaft 44. Shaft 44 extends into the locking mechanism of interlocked electrical receptacle 18 so as to be rendered incapable of lateral movement whenever an electrical plug is not fully inserted therein, as known in the art.

Figure 2:
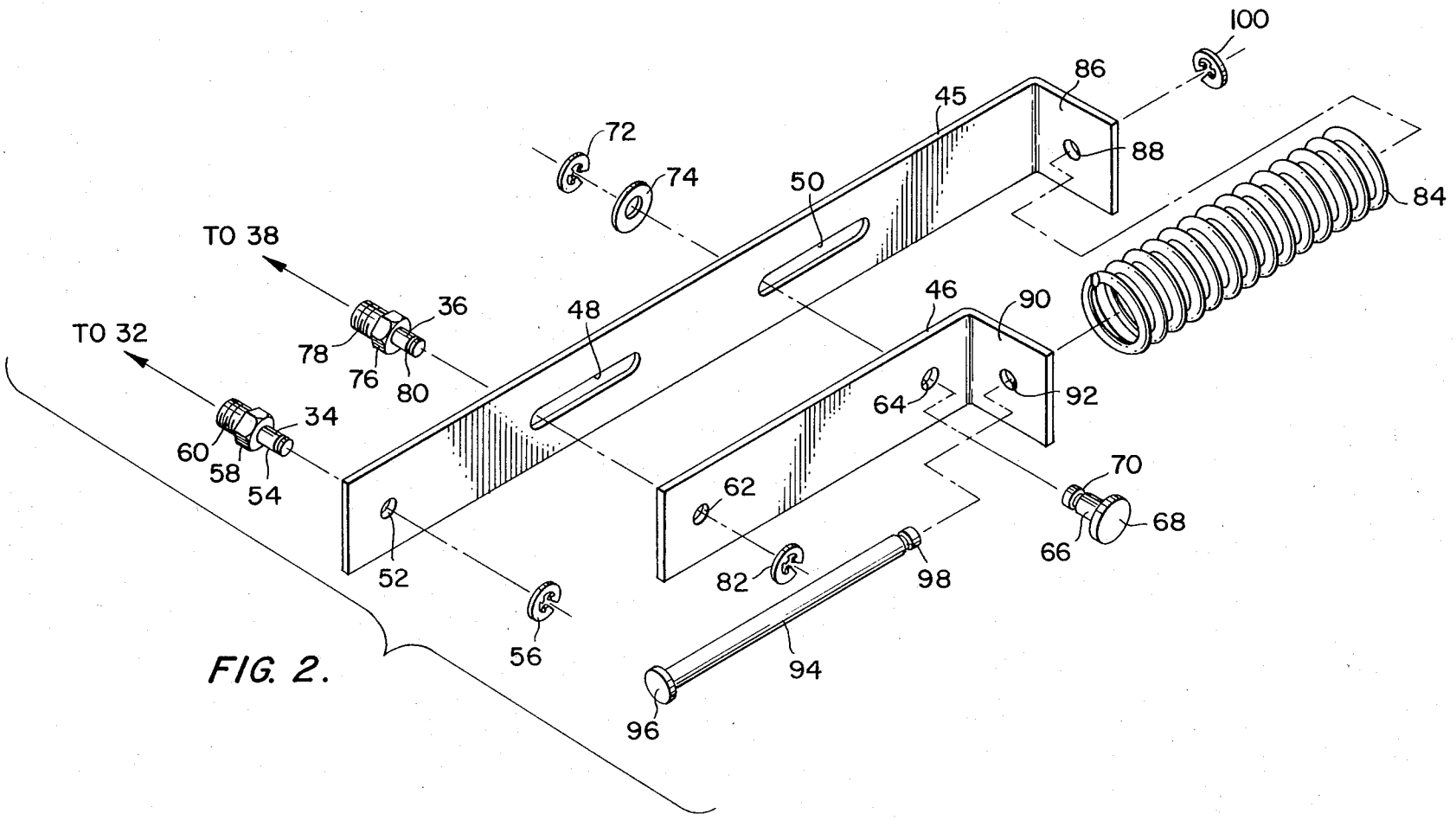
FIG. 2 is an exploded perspective detail view of the embodiment of a force override compensating linkage shown in FIG. 1.

In FIG. 2, force override compensating linkage 14 is shown in greater detail to comprise an input or force-receiving member 45 and an output or force-transmitting member 46. In a medial portion of input member 45 are formed two aligned slots 48, 50, while in one end of member 45 is formed a hole 52. Pin 34, also shown in FIG. 1, connects input member 45 to faceplate 32. In one end of pin 34 is formed an annular groove 54 which is clasped by an E-ring 56 after pin 34 is passed through hole 52. The opposite end of pin 34 is formed into a nut 58 and a longitudinal extension therebeyond comprising a threaded shaft 60, which permits attachment of pin 34, and therefore input member 45, to faceplate 32 enabling the application to input member 45 of a driving force corresponding to any operating force applied to handle 10.

Within output member 46 are formed two holes 62, 64. Pin 36, also shown in FIG. 1, connects output member 46 to bail 38, as will be described below. One end of pin 36 passes through slot 48 of input member 45 and hole 62 of output member 46, and a pin 66 passes through hole 64 of output member 46 and slot 50 of input member 45, thereby to movably connect output member 46 to input member 45 and to provide for sliding therebetween in the direction of aligned slots 48, 50. To improve wear characteristics pins 36; 66 are preferably made of a heat tempered metal.

It should be noted that while in FIG. 2, satisfactory sliding connection of members 45, 46 is obtained by use of two slots formed in input member 45 and two holes formed in output member 46, it is equally contemplated within the invention to effect the same movable connection through the reversal of one or both pairs of corresponding slots and holes. Both holes could be formed in input member 45 if both slots were in turn formed in output member 46. Alternatively, one slot and one hole could be formed in each of members 45, 46, provided that each hole in one of the members opposes a slot in the other. It may prove advantageous to place the larger two of the four apertures, the slots, in the larger of the two members 45, 46. Addition while FIG. 2 depicts slots 48, 50 as co-linear, slots 48, 50 may be disposed in parallel lines to achieve the objects of the present invention.

In order to retain pin 66 within hole 64 and slot 50 and to hold members 45, 46 against one another at a first point along the shared lengths thereof, pin 66 is provided at one end thereof with an enlarged head 68 and at the other end thereof with an annular groove 70 for clasping by an E-ring 72 after pin 66 is inserted through hole 64, slot 50, and a washer 74, as shown.

In a similar manner pin 36 is retained within slot 48 and hole 62. One end of pin 36 is formed into a nut 76 and a longitudinal extension therebeyond comprising a threaded shaft 78, which permits the attachment of pin 36 to bail 38. On the opposite end of pin 36 from nut 76 is formed an annular groove 80, which is clasped by E-ring 82 upon insertion of pin 36 through slot 48 and hole 62, as shown. Thus, input member 45 and output member 46 are movably connected in contact with one another at two distinct points along the shared lengths thereof. Also, output 46 is operably connected through pin 36 to a load in the form of the mass and mechanical resistance of bail 38, toggle 41, interlock arm 43, shaft 44, and switch or circuit breaker 16.

In accordance with one aspect of the present invention bias means are provided for urging a force-receiving member, such as input member 45, into a rigid relationship with a force-transmitting member, such as output member 46. As further shown by way of example in FIG. 1, the bias means comprises a coil spring 84 compressed between members 45, 46 by connection means. By way of example and not limitation, at the opposite end of input member 45 from hole 52 there is formed a flange 86 in which is formed a hole 88. On the corresponding end of output member 46 is formed a similar flange 90 opposite to flange 86 and having formed therein a hole 92. When the compensating linkage of FIG. 1 is assembled, spring 84 is pre-loaded in a compressed state between flanges 86, 90 and a shaft 94 having at one end thereof an enlarged head 96 and at the other end thereof an annular groove 98 is slid through hole 92, along the axis of spring 84, and through hole 88 to be retained in position by the clamping action of an E-ring 100 upon groove 98.

Thus, when an electrical plug is properly and completely inserted into interlocked electrical receptacle 18, shaft 44 is free to slide in and out of the locking mechanism thereof. Interlock arm 43 is consequently freed, permitting bail 38, compensating linkage 14, faceplate 32, connector arm 26, cam 24, and handle 10 to be moved. In this normal mode of operation, members 45, 46 of compensating linkage 14 are held in rigid relation one with another by spring 84, which is compressed upon installation to a predetermined pre-load threshold force slightly greater than that needed to operate switch or circuit breaker 16 and the mechanical linkage associated therewith.

A driving force corresponding to an operating force applied to handle 10 is applied by rotation of faceplate 32 to input member 45 at hole 52 and transferred through spring 84 to output member 46 which is directly attached at hole 62 to bail 38. The pre-load in spring 84 is sufficient to resist a driving force large enough to move all of the interconnected linkages and mechanisms of the enclosed switch or circuit breaker. Thus, in this mode of operation there is no relative movement between input member 45 and output member 46, and compensating link 14 performs essentially as a solid link transmitting rotation of faceplate 32 into movement of bail 38. In the process of moving handle 10 from its "off" position resting against stop 102 to the "on" position, input member 45 is moved in the direction of the arrow depicted thereon from a rest position to an activated position, actuating a load representing the mass and mechanical resistance of bail 38, interlock arm 43, toggle 41, and switch or circuit breaker 16 to energize the latter. This load is understood to have a movable state, when an electrical plug is completely inserted into interlocked electrical receptacle 18 freeing shaft 44 for lateral movement, and an immovable state otherwise.

If a plug is not fully inserted into interlocked electrical receptacle 18, lateral motion of shaft 44 is prevented, and correspondingly interlock arm 43, bail 38, and toggle 41 are incapable of movement. If an operator through inadequate training, failure to read instructions, or inattentiveness to the condition of the equipment, erroneously attempts to move handle 10 from the "off" to the "on" position by applying the normal force needed to activate switch or circuit breaker 16, handle 10 will resist such motion. With the application of additional erroneous force to handle 10, the predetermined threshhold force applied between input member 45 and output member 46 by compressed spring 84 will be exceeded, and spring 84 will begin to be further compressed by flange 86 of input member 45 against flange 90 of output member 46. As spring 84 compresses at least one of holes 88, 92 rides upon shaft 94, and input member 45 slides toward its activated position, while output member 46 remains stationary due to the interconnection thereof at pin 36 to immobilized bail 38. The resulting waste movement of input member 45, however, permits faceplate 32, connector arm 26, cam 24, and handle 10 to move into their respective "on" positions. The additional compression to spring 84 imparted by waste movement of input member 45 serves to automatically return handle 10 to the "off" position when the erroneous operating force is released.

Thus, it can be seen that the bias means comprising, by way of example, flanges 86, 90, spring 84, and shaft 94 is a multipurpose bias means responsive to the movement of input member 45 for effecting three separate functions. In normal operation with switch or circuit breaker 16 and attached linkages in the movable state, as when the locking mechanism of interlocked electrical receptacle 18 is released by the full insertion thereinto of an electrical plug, movement of input member 45 from its rest position to its activated position is directly converted into movement of output member 46. Through the mechanical linkage depicted in FIG. 1, input member 45 thereby actuates a load in the form of the mass and mechanical resistance of bail 38, interlock arm 43, toggle 41, and switch or circuit breaker 16 to energize the latter. On the other hand, when that load is in its immovable state, as when shaft 44 is constrained by the locking mechanism of interlocked electrical receptacle 18 because an electrical plug is not properly inserted thereinto, the bias means permits waste movement of input member 45 from the rest position thereof whenever an erroneous force at handle 10 exceeds a predetermined threshhold. Finally, the bias means automatically returns input member 45 to its rest position, and correspondingly handle 10 to the "off" position, following the release of any erroneous force in excess of the predetermined threshhold. This spring-back feature prevents a false indication that the enclosed switch or circuit breaker being manipulated has actually been energized.

Figure 3:
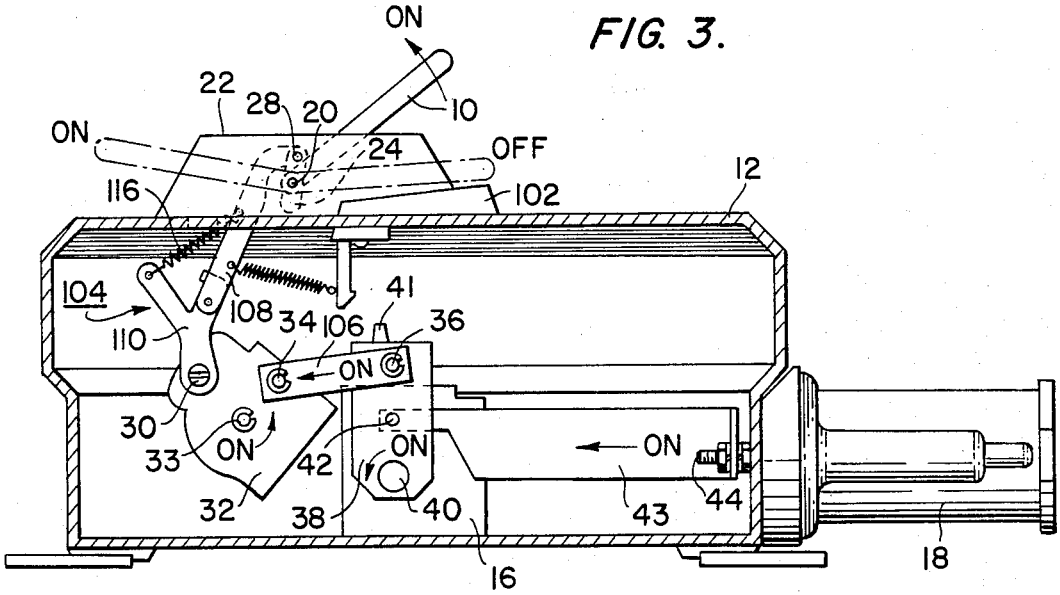
FIG. 3 is a side sectional elevation of an enclosed dead front safety device in which a second force override compensating linkage embodying the present invention is operatively installed.

A second embodiment of a force override compensating linkage embodying the present invention and capable of use with dead front safety devices having an operating handle on the top of the enclosure thereof is shown in FIG. 3 installed as one component of a mechanical operating linkage for an enclosed switch or circuit breaker and designed generally by reference numeral 104. Like elements in FIGS. 1 and 3 are designated by like reference numerals. One end of compensating linkage 104 is connected at point 28 to cam 24, which is mounted in boss 22 for rotation with operator handle 10 about shaft 20. The opposite end of compensating linkage 104 is pivotally mounted to faceplate 32 at point 30. Therefore, it can be seen that compensating linkage 104 replaces connector arm 26 of the dead front safety device shown in FIG. 1. The remainder of the apparatus in FIG. 3 is identical to that depicted in FIG. 1, with the exception that a single solid link 106 connecting faceplate 32 through pin 34 to bail 38 at pin 36 replaces compensating linkage 14 of FIG. 1.

In FIG. 4 compensating linkage 104 is seen in more detail to include an input or force-receiving member 108 mounted at point 112 to an ouput or force-transmitting member 110 for pivoting in a predetermined direction indicated by the arrow P. Output member 110 is provided with a stop 114, which engages a side edge of input member 108 and prevents pivoting of members 108, 110 in a direction opposite the predetermined direction. It should be understood that a stop, such as stop 114, could with equal effectiveness be provided at.a suitable location on input member 108 for engaging an edge of output member 110 to prevent pivoting of members 108, 110 in a direction opposite the predetermined direction.

In accordance with one aspect of the present invention bias means are provided for urging a force-receiving member, such as input member 108, into a rigid relationship with a force-transmitting member, such as output member 110. As further shown by way of example and not limitation in FIG. 4, an extension spring 116 is connected to input member 108 at eye 118 and to output member 110 at eye 120 forced in an arm 122 of output member 110 extending away from pivot point 112 in the predetermined direction indicated by arrow P. Spring 116 urges input member 108 against stop 114 to the extent of a predetermined force sufficient to keep input member 108 against stop 114 when an operating force applied to handle 10 actuates a load in the form of the mass and mechanical resistance of switch or circuit breaker 16 and the associated mechanical linkage shown when that load is in its moveable state.

In the normal mode of operation, with an electrical plug completely inserted into interlocked electrical receptacle 18, the locking mechanism therein permits lateral movement of shaft 44 and interlock arm 43 connected thereto, as previously explained. Therefore, bail 38 is free to rotate about hub 40 and trip toggle 41 of switch or circuit breaker 16 in response to rotation of faceplate 32 about pivot 33. Under these conditions, when switch or circuit breaker 16 is to be energized, operating handle 10 is moved from the "off" position against stop 102 to the "on" position thereof. This rotates cam 24 and point 28 thereon about axle 20. Spring 116 exerts such force between members 108, 110 as to permit compensating linkage 104 to function as a solid link in transmitting rotational movement to faceplate 32.

As can best be understood in relation to FIGS. 3 and 4 taken together, an operating force applied to handle 10 tends to compress compensating linkage 104 between points 28, 30, which can be said to define a reference line A—A. An important aspect of the design of compensating link 104 is that point 112, at which input member 108 and output member 110 are connected, is not on reference line A—A, but is removed therefrom in the direction of the predetermined direction of pivoting indicated by arrow P. Therefore, point 112 is located on the side of reference line A—A upon which pivoting of members 108, 110 at point 112 will tend to move point 112 away from reference line A—A. By this arrangement compressive forces acting between points 28, 30 do so at least at a moment arm M equal to the distance between point 112 and reference line A—A, producing torques in members 108, 110 which tend to rotate stop 114 on output member 110 away from input member 108. This tendency of output member 110 to rotate relative input member 108 is countered by the tensile force of spring 116 to the extent of a predetermined force which slightly exceeds that necessary to maintain compensating linkage 104 as a rigid structure when an operating force is exerted on handle 10 to close switch or circuit breaker 16 in its movable state.

When the locking mechanism in interlocked electrical receptacle 18 is engaged, however, as when an electrical plug is not entirely inserted thereinto, movement of shaft 44, interlock arm 43, bail 38, link 106, and faceplate 32 is prevented. Under these conditions, if an operator erroneously attempts to move handle 10 from the "off" to the "on" position with the normal force required to do so, handle 10 will resist movement. With the application of additional erroneous force on handle 10, sufficient compressive force will be exerted between points 28, 30 at the ends of compensating linkage 104 to overcome the tendency of spring 116 to urge stop 114 of output member 110 against input member 108. When this occurs, spring 116 becomes further extended and compensating link 104 collapses as shown in FIG. 5. Operating handle 10 moves to the "off" position, while point 30 on faceplate 32 remains immobile. The additional tensile force arising in spring 116 due to waste motion of input member 108 associated with the collapse of compensating linkage 104 serves to return handle 10 to the "off" position when the erroneous operating force is released.

Thus it can be seen that the bias means of compensating link 104 comprising, by way of example, tensile spring 116 under tension between eyes 118, 120 is a multipurpose bias means responsive to the movement of input member 108 from a rest position. When the load comprising faceplate 32, linkage 106, bail 38, switch or circuit breaker 16, interlock arm 43, and shaft 44 is in a movable state, as when the locking mechanism of interlocked electrical receptacle 18 is released by the full insertion thereinto of an electrical plug, the bias means serves to effect actuating of that load to energize switch or circuit breaker 16 upon movement of input member 108 from its rest position to an activated position thereof. On the other hand, with shaft 44 constrained by the locking mechanism of interlocked electrical receptacle 18, as when an electrical plug is not properly inserted thereinto, that load is in an immovable state, and the bias means permits waste movement of input member 108 from the rest position when an erroneously applied operative force produces an activating force upon compensating linkage 104 which is greater than needed to activate switch or circuit breaker 16 when the locking mechanism of receptacle 18 is released. Finally, the bias means serves to return input member 108 to its rest position, and correspondingly operating handle 10 to its "off" position, after the release of any such excess erroneously applied force. This spring-back feature prevents a false indication that the enclosed switch or circuit breaker being manipulated has actually been energized.

A third embodiment of the present invention is one capable of use with electrical receptacle interlocked enclosed switches or circuit breakers having operating handles on the side of the enclosures thereof. In this instance, the operating or reset handle itself serves as one element of a compensating linkage embodying the teaching of the present invention. FIG. 6 shows a handle 124 of such a compensating linkage installed on the side of housing 12 of an enclosed switch or circuit breaker having an electrical receptacle 18 interlocked therewith.

Figure 7:
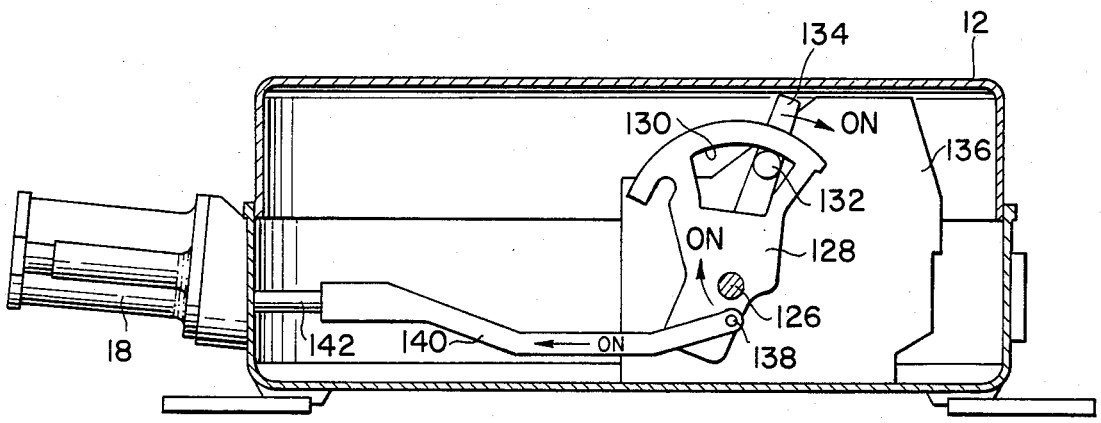
FIG. 7 is a side sectional elevation of the device of FIG. 6.

FIG. 7 shows the device of FIG. 6 with the side of housing 12 cut away to disclose the interior mechanical operating linkage thereof. Operating shaft 126 connected to handle 124 and extending through housing 12 for rigid attachment to operator crank 128 is shown in cross section. Crank 128 and shaft 126 are mounted for rotation together about the longitudinal axis of operating shaft 126. Formed in operator crank 128 is a window 130 through which extends a lug 132 attached to an operator bail 134. Operator bail 134 energizes switch or circuit breaker 136 when moved in the direction of the arrow as shown. Attached to a point 138 on operator crank 128 is one end of a connector arm 140. The other end of connector arm 140 is fixed to a shaft 142 which extends into a locking mechanism in interlocked electrical receptacle 18, as known in the art. The locking mechanism immobilizes shaft 142 and connector arm 140 attached thereto to prevent movement in the direction of the arrow shown when a plug is not fully inserted into interlocked electrical receptacle 18.

Figure 8:
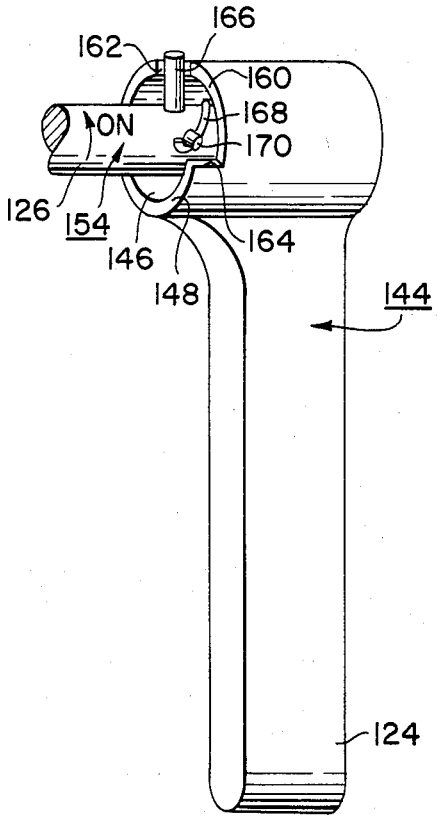
FIG. 8 is a perspective detail view of the handle of FIGS. 6.
Figure 9:
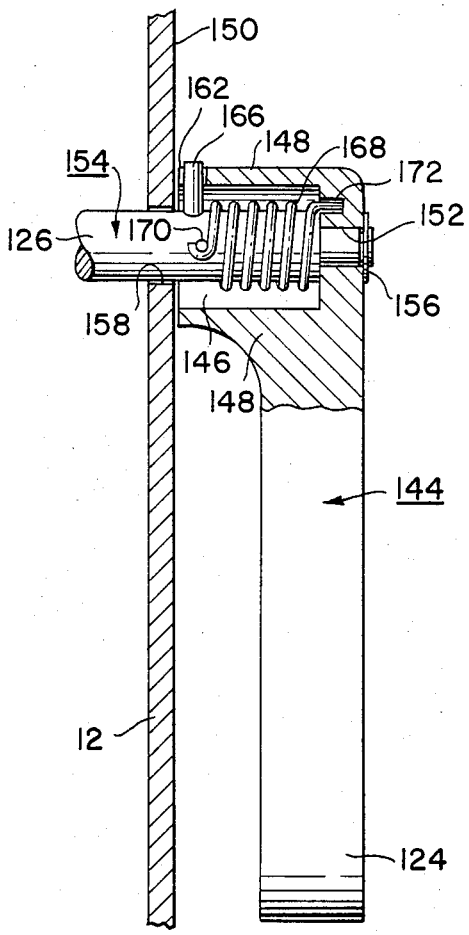
FIG. 9 is a detail view in partial section of the handle of FIG. 8.

FIGS. 8 and 9 show an embodiment of the compensating linkage of the present invention suitable for use on the side of a housing for a dead front safety device to comprise an input or force-receiving member 144 fashioned at a first end thereof into reset or operating handle 124 to which a driving force identical to an operating force for energizing switch or circuit breaker 136 is applied to rotate input member 144. The second end of input member 144 is formed into a generally cylindrical chamber 146 having walls 148 normal an outer surface 150 of housing 12, when input member 144 is mounted thereon. One end of chamber 146 opens against surface 150 of housing 12 while in the other end thereof is formed an aperture 152 concentric with the axis of rotation of input member 144. One end of an output or force transmitting member 154 is rotatably received within aperture 152 from the side thereof opening into chamber 148 and secured therein by an E-ring 156 on the outside of member 144. The other end of output member 154 extends into the interior of housing 12 through a hole 158 for connection to operator crank 128 and a load representing the mass and mechanical resistance of switch or circuit breaker 136 and the linkages associated therewith depicted in FIG. 7.

As most clearly seen in FIG. 8, a portion of wall 148 of chamber 146 adjacent surface 150 of housing 12 is removed to form a circumferentially elongated recess 160 having end walls 162, 164 generally normal outer surface 150 of housing 12. On the surface of output member 154 at a portion thereof exterior to housing 12, there is provided a radially extending stop 166 which travels within recess 160 as members 144, 154 rotate relative one another.

According to one aspect of the present invention, bias means are provided for urging a force-receiving member, such as input member 144, into a rigid relationship with a force-transmitting member, such as output member 154. As further shown by way of example and not limitation in FIGS. 8 and 9, a torsion spring 168 is attached to output member 154 exterior housing 12 at a knob 170 thereon exterior housing 12 and to the second end of input member 144 at a notch 172 formed in the end wall of chamber 146 adjacent aperture 152. Spring 168 is wound under tension around that end of output member 154 which is housed within chamber 146. The action of spring 168 rotates input member 144 relative output member 154 and urges stop 166, against end wall 162 of recess 160 to the extent of a predetermined force sufficient to keep input member 144 against stop 166 when an operating force applied to handle 124 actuates the load represented by switch or circuit breaker 136 and associated mechanical linkage within housing 12 when the load is rendered in its movable state.

The load is in the movable state thereof when an electrical plug is completely inserted into interlocked electrical receptacle 18, the locking mechanism of which then permits lateral movement of shaft 142 and interlock arm 140 connected thereto. Therefore, in response to rotation of operating shaft 126, operator crank 128 is free to rotate as shown by the arrow in FIG. 7, tripping lug 132 attached to operator bail 134 of switch or circuit breaker 136. In this normal mode of operation, members 144 and 154 of the compensating linkage of the present invention are held in rigid relation one with another by spring 168, which is wound upon installation to a predetermined pre-load force slightly greater than that needed to operate switch or circuit breaker 136 and the mechanical linkage associated therewith.

As best understood from FIGS. 8 and 9 taken together, an operating force applied to handle 124 is identical with a driving force applied to input member 144 and is transferred through spring 168 to knob 170 on output member 154. The pre-load of spring 168 is sufficient to resist a driving force large enough to move all of the interconnected linkages and mechanisms of the enclosed switch or circuit breaker 136 depicted in FIG. 7. Thus, in the normal mode of operation there is no relative movement between input member 144 and output member 154, and the two members 144, 154 function as a solid operating linkage transmitting operator imparted rotation of handle 124 to operator crank 128 for energizing switch 136.

If no plug is fully inserted into interlocked electrical receptacle 18, lateral motion of shaft 142 is prevented, and correspondingly interlock arm 140 and operator crank 128 are incapable of movement. If an operator, through inadequate training, failure to read instructions, or inattentivenes to the condition of the equipment,.erroneously attempts to move handle 124 from the "off" position by applying the normal force needed to activate switch or circuit breaker 136, handle 124 will resist such motion. With the application of additional erroneous force to handle 124, the predetermined threshhold force applied between input member 144 and output member 154 by pre-loaded spring 168 will be exceeded, and spring 168 will yield to tighter winding between knob 170 and notch 172. As spring 168 winds tighter, end wall 162 of recess 160 moves circumferentially away from stop 166 attached to output member 154; and input member 144 rotates towards its activated position, while output member 154 and operating shaft 126 remains stationary due to the interconnection thereof to immobilized operator crank 128. The resulting waste movement of input member 144, however, permits handle 124 to move to the "on" position thereof. The additional compression imparted to spring 168 by waste movement of input member 144 serves to automatically return handle 124 to the "off" position when the erroneous operating force is released.

Thus, it can be seen that the bias means of this embodiment of the present invention, comprising, by way of example, spring 168, knob 170, and notch 172 is a multipurpose bias means responsive to the movement of input member 144 for effecting three separate functions. In normal operation with switch or circuit breaker 136 and attached linkages in the movable state, as when the locking mechanism of interlocked electrical receptacle 18 is released by the full insertion thereinto of an electrical plug, movement of input member 144 from its rest position to its activated position is directly converted into movement of output member 154. Through the mechanical linkage depicted in FIG. 7, members 144, 154, thus operating as a solid linkage actuate a load representing the mass mechanical resistance of operator crank 128, operator bail 134, connector arm 140 and shaft 142 to energize switch or circuit breaker 136. On the other hand, with shaft 142 constrained by the locking mechanism of interlocked electrical receptacle 18, as when an electrical plug is not properly inserted thereinto, that load is in an immovable state, and the bias means permits waste movement of input member 144 from the rest position thereof whenever an erroneous force at handle 124 exceeds the predetermined threshhold. Finally, the bias means automatically returns input member 144 to its rest position, and correspondingly handle 124 to the "off" position, following the release of any erroneous force in excess of the predetermined threshhold. This springback feature prevents a false indication that the enclosed switch or circuit breaker being manipulated has actually been energized.

It will be apparent to those skilled in the art that modifications and variations can be made in the apparatus of this invention. The invention in its broader aspect is, therefore, not limited to the specific details, representative methods and apparatuses, and illustrative examples shown and described. Accordingly, alterations may be made from such details, without departing from the spirit or scope of applicant's general inventive concept.

What is claimed is:

1. In a dead front safety device having a reset handle connected to a mechanism for energizing a safety circuit by a multi-component mechanical operating linkage for transmitting an operating force applied to said reset handle to said energizing mechanism when said circuit has been opened, and having an interlock for preventing movement of said energizing mechanism until the release of said interlock by the undertaking of collateral safety-related procedure, the improvement comprising a force override compensating linkage as a component of said mechanical operating linkage, said compensating linkage comprising:

a. a force-receiving member to which a driving force corresponding to said operating force is applied;

b. a force-transmitting member movably connected to said force-receiving member and operably connected through components of said operating linkage to said energizing mechanism for imparting thereto an activating force corresponding to said driving force; and c. bias means for transferring said driving force to said force-transmitting member by moving said force-receiving member in rigid relation with said force-transmitting member, said bias means permitting movement of said force-receiving member relative said force-transmitting member whenever said operating force exceeds a predetermined value.

2. The improvement as recited in claim 1, wherein said bias means reverses any movement of said force-receiving member relative said force-transmitting member when said operating force ceases to be applied to said reset handle.

3. The improvement as recited in claim 2, wherein:

a. said force-transmitting member is movably connected to said force-receiving member to permit sliding of said force-transmitting member relative said force-receiving member by at least one pin passing through an eye and a longitudinally disposed slot individually formed in said force-receiving and force-transmitting members; and b. said bias means comprises a spring connected between said force-receiving and force-transmitting members, the restoring force of said spring urging said force-receiving member into rigid relation with said force-transmitting member.

4. The improvement as recited in claim 2, wherein:

a. said force-receiving member has first and second ends and said driving force is applied longitudinally to said first end thereof;

b. said force-transmitting member has first and second ends and said energizing mechanism is operably connected through components of said operating linkage to said first end thereof; and c. said force-transmitting member is movably connected to said force-receiving member to permit sliding of said force-transmitting member relative said force-receiving member in the direction of the common lengths thereof by at least one pin passing through an eye and a longitudinally disposed slot individually formed in said force-receiving and force-transmitting members.

5. The improvement as recited in claim 4, wherein said bias means comprises a coil spring compressed between said force-receiving and force-transmitting members by connection means, the restoring force of said spring urging said force-receiving member into rigid relation with said force-transmitting member.

6. The improvement as recited in claim 5, wherein said connection means comprises:

a. a shaft disposed along the axis of said spring; and b. a pair of flanges individually provided on said second ends of said force-receiving and force-transmitting members compressing said spring, each of said flanges having formed therein a hole for receiving and for permitting sliding of at least one of said flanges upon said shaft.

7. The improvement as recited in claim 2, wherein:

a. said force-receiving member has first and second ends and said driving force is applied at a first point located on said first end thereof; and b. said force-transmitting member has first and second ends, said first end thereof being operably connected at a second point through components of said operating linkage to said energizing mechanism at a second point and said second end thereof pivoted with said second end of said force-receiving member at a third point separated from a reference line between said first and second points, one of said second ends being provided with a stop to prevent pivoting of said second ends of said force-receiving and said force-transmitting members in the direction of said reference line.

8. The improvement as recited in claim 7, wherein said bias means comprises a spring in tension between said force-receiving and force-transmitting members the restoring force of said spring tending to resist pivoting of said force-receiving and force-transmitting members in a direction away from said line between said first and second points.

9. The improvement as recited in claim 2, wherein:

a. said force-receiving member has first and second ends, and said second end having formed therein a hole concentric with an axis of rotation of said force-receiving member and said driving force being applied to said first end so as to rotate said force-receiving member about said axis; and b. said force-transmitting member has first and second ends, said first end thereof being operably connected through said operating linkage to said energizing mechanism and said second end thereof being rotatably received within said hole and provided with a stop to prevent rotation of said force-receiving member in a direction opposite a predetermined direction relative said force-transmitting member.

10. The improvement as recited in claim 9, wherein said bias means comprises a torsion spring attached to said second ends of said force-receiving and force-transmitting members and wound about said second end of said force-transmitting member for resisting rotation of said force-receiving member relative said force-transmitting member in the direction opposite said predetermined direction.

11. The improvement as recited in claim 10, wherein said first end of said force-receiving member is fashioned into said reset handle for receiving said operating force.

12. A force override device coupled to an actuatable load having a moveable state and an imovable state, said device comprising:

a. an input member having a rest position and an activated position;

b. multipurpose bias means responsive to the movement of said input member for:

i. actuating said load in said moveable state upon movement of said input member from said rest position to said activated position, ii. permitting waste movement of said input member from the rest position under erroneously applied force greater than a predetermined threshold in said immovable state of said load, iii. returning said input member to said rest position after release of said erroneously applied force; and c. an output member attached to said load and movably connected directly to said input member, said output member being urged to the extent of said predetermined threshold by said bias means into a rigid relationship with said input member.

13. A force override device, as recited in claim 12, wherein:

a. said movement of said input member from said rest position to said activated position is a translational movement; and b. said output member is so movably connected to said input member as to permit sliding of said output member relative said input member in a direction parallel said translational movement of said input member.

14. A force override device, as recited in claim 13, including a slot in said output member parallel, said translational movement, an eye in said input member aligned with said slot, and a pin extending through said slot into said eye for movably interconnecting said input member to said output member.

15. A force override device, as recited in claim 14, wherein said bias means comprises a coil spring compressed between said input and said output members by connection means, the restoring force of said spring urging said input member to the extent of said predetermined threshold into rigid relation with said output member.

16. A force override device, as recited in claim 15, wherein said connection means comprises:

a. a shaft disposed along the axis of said spring; and b. a pair of flanges individually provided on respective ends of said input and output members compressing said spring, each of said flanges having formed therein a hole for receiving and for permitting sliding of at least one of said flanges upon said shaft.

17. A force override device, as recited in claim 12, wherein:

a. said movement of said input member from said rest position to said activated position is a combination of translation and rotation; and b. said input member is so movably connected to said output member as to permit pivoting of said input member relative said output member in a predetermined direction and to prevent rotation of said input member relative said output member in a direction opposite said predetermined direction.

18. A force override device, as recited in claim 17, wherein:

a. said movement of said input member from said rest position to said activated position is as a result of an activating force applied at a first point located on said input member;

b. said output member is operably connected to said load at a second point, said first and second points defining a reference line; and c. said input and output members are mounted for pivoting at a third point to the side of said reference line, upon which pivoting of said input and output members in said predetermined direction simultaneously moves said third point away from said reference line.

19. A force override device, as recited in claim 18, wherein said bias means comprises a coil spring in tension between said input and said output members, said spring having a restoring force resisting rotation of said input member relative said output member in said predetermined direction to the extent of said predetermined threshold.

20. A force override device, as recited in claim 12, wherein:

a. said movement of said input member from said rest position to said activated position is a rotational movement; and b. said output member is movably connected to said input member to permit rotation of said output member relative said input member on an axis coincident with said rotational movement of said input member.

* * * * *